United States Patent [19]

Davis

[11] Patent Number: 5,077,472

[45] Date of Patent: Dec. 31, 1991

[54] ION MIRROR FOR A TIME-OF-FLIGHT MASS SPECTROMETER

[75] Inventor: Stephen C. Davis, Hale, England

[73] Assignee: Kratos Analytical Limited, Manchester, United Kingdom

[21] Appl. No.: 550,400

[22] Filed: Jul. 10, 1990

[30] Foreign Application Priority Data

Jul. 12, 1989 [GB] United Kingdom ..... 8915972

[51] Int. Cl.[5] ..... H01J 39/34

[52] U.S. Cl. ..... 250/287; 250/292; 250/294

[58] Field of Search ..... 250/287, 286, 281, 282, 250/396 R, 396 ML, 292, 294

[56] References Cited

U.S. PATENT DOCUMENTS

| | | | |
|---|---|---|---|
| 3,621,242 | 11/1971 | Ferguson et al. | 250/287 |
| 3,727,047 | 4/1973 | Janes | 250/287 |
| 3,767,914 | 10/1973 | Mueller et al. | 250/287 |
| 3,937,954 | 2/1976 | Fite | 250/282 |
| 3,953,732 | 4/1976 | Oron et al. | 250/287 |
| 4,126,781 | 11/1978 | Siegel | 250/396 R |
| 4,694,168 | 9/1987 | LeBeyec et al. | 250/287 |
| 4,704,532 | 11/1987 | Hua | 250/292 |
| 4,731,532 | 3/1988 | Frey et al. | 250/287 |

FOREIGN PATENT DOCUMENTS

| | | |
|---|---|---|
| 2137520 | 7/1971 | Fed. Rep. of Germany . |
| 1405180 | 9/1975 | Fed. Rep. of Germany . |
| 3428944 | 2/1985 | Fed. Rep. of Germany . |
| 1567151 | 5/1980 | United Kingdom . |
| 2080021 | 1/1982 | United Kingdom . |
| 2147140 | 5/1985 | United Kingdom . |
| 2153139 | 8/1985 | United Kingdom . |

OTHER PUBLICATIONS

B. A. Mamyrin et al., "The Mass Reflection, a New Nonmagnetic Time-of-Flight Mass Spectrometer with High Resolution" Soc. Phys. JeIp, 37 (1973) 4S.

J. M. B. Bakker, "The Spiration", vol. 5, p. 278.

AIP Conference Proceedings No. 183, pp. 49–71—Cosmic Abundances of Matter Meeting—"The Abundances of Elements and Isotopes in the Solar Wind" by Gloeckler G. and Geiss J., 1988.

*Primary Examiner*—Jack I. Berman
*Assistant Examiner*—Kiet T. Nguyen
*Attorney, Agent, or Firm*—Leydig, Voit & Mayer

[57] ABSTRACT

An ion mirror for a time-of-flight mass spectrometer comprises a monopole electrode structure which operates at d.c. voltage. This electrode structure defines a field region in which an incident ion experiences an electrostatic reflecting force having a magnitude proportional to the separation of the ion from where it entered the field region or from where the ion exits the field region, if the latter separation is smaller. The ion occupies the field region for a time interval related to its mass but not its energy.

20 Claims, 6 Drawing Sheets

ION MIRROR FOR A TIME-OF-FLIGHT MASS SPECTROMETER

BACKGROUND OF THE INVENTION

This invention relates to an ion mirror for a time-of-flight mass spectrometer.

Time-of-flight mass spectrometers operate on the principle that monoenergetic ions having different masses travel through a drift space at different velocities. This enables ions of different masses to be detected separately and thereby distinguished from one another.

A problem arises if, as is often the case, the ions do not all have the same energy. In these circumstances, the more energetic ions, which move at relatively high velocities, would arrive at a detector ahead of less energetic ions having the same mass. This spreading of flight times is undesirable and tends to limit the mass-resolving power of the spectrometer.

Spectrometers have been developed which incorporate so-called "time-focussing" arrangements, whose object is to reduce the spread of flight times which occurs with multi-energetic ions.

One category of "time-focussing" arrangement subjects the ions to a static electric field, and an example of this is the "reflectron", described by B. A. Mamyrin, V. I. Karatev, D. V. Schmikk and V. A. Zagulin in Soviet Physics JETP, 37 (1973)4S. The reflectron subjects the ions to a uniform electric field so as to cause their reflection. The more energetic ions penetrate deeper into the field region than the less energetic ions and, with a suitable choice of field parameters, it is possible to arrange that ions having different energies, but the same mass, all arrive at a detector at roughly the same time.

Other arrangements using static electric fields include the "spiratron", described by J. M. B. Bakker in "Advances in Mass Spectrometry" Vol. 5, p. 278, Applied Science Publishers Ltd., and the so-called "Poschenreider" device, described, for example, in German Patent No. 2,137,520.

Other kinds of "time-focussing" arrangement subject the ions to time-varying fields which have the effect of decelerating the faster ions and accelerating the slower ions with the aim of equalising the flight times of all ions having the same mass.

None of these known time-focussing arrangements is completely effective and, in practice, the flight times of ions which have the same mass do still exhibit an energy dependency, and this reduces the mass-resolving Power of the spectrometer.

BRIEF SUMMARY OF THE INVENTION

With the aim of alleviating this problem, the present invention provides an ion mirror, suitable for use in a time-of-flight mass spectrometer, for reflecting ions travelling along a path, comprising means defining a field region wherein each ion is subjected to an electrostatic field causing the ion to be reflected in, or about a plane, characterised in that the electrostatic field is an electrostatic quadrupole field whereby the ion occupies the field region for a time interval related to the mass, but not the energy of the ion.

Adopting a Cartesian coordinate system, the ion may be reflected in, or about, an X-Y plane and the distribution of potential V(x,y) in the electrostatic quadrupole field would then substantially satisfy the condition $$V(x,y)=V_o(x^2-y^2)$$

where $V_o$ is a constant and x,y are the X,Y position coordinates in the field region.

Since an ion occupies the field region for a time interval which depends only on its mass, this enables the ions to be distinguished from one another in terms of their masses even if they have different energies. Moreover, because ions which have the same mass have exactly the same flight time through the field region this eliminates any significant spread of their arrival times at an associated detector.

Accordingly, an ion mirror, as defined, has particular utility in a time-of-flight mass spectrometer.

In accordance with a further aspect of the invention there is provided a time-of-flight mass spectrometer comprising an ion source, an ion mirror for reflecting ions produced by the ion source and detection means for detecting ions reflected by the ion mirror, the ion mirror comprising means defining a field region wherein each ion is subjected to an electrostatic field causing the ion to be reflected in, or about a plane, characterised in that the electrostatic field is an electrostatic quadrupole field whereby the ion occupies the field region for a time interval related to the mass, but not the energy of the ion.

BRIEF DESCRIPTION OF THE DRAWINGS

Ion mirrors and time-of-flight mass spectrometers embodying the invention are now described, by way of example only, with reference to the accompanying drawings, in which.

DESCRIPTION OF THE PREFERRED EMBODIMENTS

Figure 1:
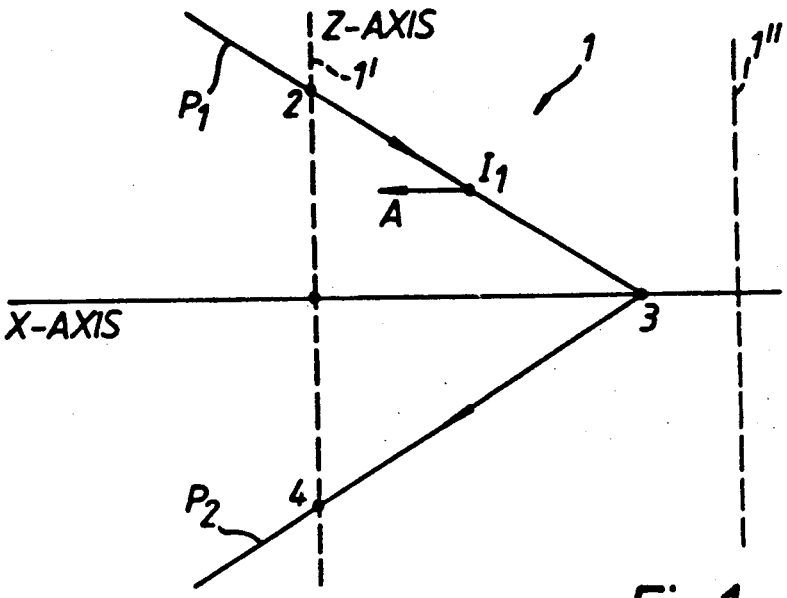
FIG. 1 is a diagrammatic illustration of an ion mirror in accordance with the invention.

FIG. 1 of the drawings illustrates diagrammatically how an ion mirror in accordance with the invention affects the motion of an incident ion.

It will be assumed, for clarity of illustration, that the ion mirror establishes a field region 1 bounded by broken lines 1',1'', and that an ion $I_1$, of mass $m_1$ say, moving on an incident path $P_1$, enters the field region at a point 2, undergoes a reflection at a point 3, returns on a path $P_2$ and finally exits the field region at a point 4.

In this example, the paths $P_1$ and $P_2$ lie in the X-Z plane and the incident ion is reflected about the X-Y Plane (normal to the page).

As the ion travels through the field region, the ion mirror subjects it to an electrostatic reflecting force which acts in the direction of arrow A in FIG. 1 and has a magnitude directly proportional to the separation of the ion from a line L joining the entry and exit points 2, 4, in a direction normal to that line. Put another way, the magnitude of the electrostatic reflecting force is proportional to the separation of the ion from its entry point 2, or from its exit point 4, if the ion is closer to the latter point; that is the magnitude of the reflecting force is proportional to the separation of the ion, on path $P_1$, from the entry point 2 and to the separation, on path $P_2$, from the exit point 4.

Thus, the reflecting force causes an ion to decelerate as it moves on path $P_1$ and to accelerate as it moves on path $P_2$, having come to rest momentarily at the reflection point 3.

The electrostatic force F, to which an ion is subjected in the field region, can be expressed as $$F = -kx,$$

where x is the separation of the ion from line L joining the entry and exit points, and k is a constant.

With an electrostatic force of this form, the equation of motion of the ion is akin to that associated with damped simple harmonic motion, and it can be shown that the time interval t during which the ion travels from its point of entry 2 to the reflection point 3 is given by the expression $$t = \frac{\pi}{2}\left(\frac{m}{k}\right)^{\frac{1}{2}},$$

where m is the mass of the ion.

Thus, the ion occupies the field region for a total time interval T, given by, $$T = 2t = \pi\left(\frac{m}{k}\right)^{\frac{1}{2}}$$

As this result shows, an ion occupies the field region for a time interval which depends only on its mass, and this enables the ions to be distinguished from one another as a function of their masses, even if they have different energies.

Thus, if ion $I_1$ (which has a mass $m_1$) occupies the field region for a time interval $T_1$, an ion $I_2$, having a smaller mass $m_2$, would occupy the field region for a correspondingly shorter time interval $T_2$, given by $$T_2 = \left(\frac{m_2}{m_1}\right)^{\frac{1}{2}} T_1$$

Consequently, the two ions $I_1$, $I_2$ would have different flight times and would exit the field region at different times enabling them to be detected separately.

As will be clear from this analysis, ions which have the same mass and which entered the field region at the same time, would also exit the field region at exactly the same time; that is to say, the ions have identical flight times through the field region.

Accordingly, the ion mirror has particular utility in a time-of-flight mass spectrometer, offering an improvement over the resolution which can be attained using known spectrometer arrangements (such as the combination of a conventional drift tube and a reflectron).

The electrostatic field to which the ions are subjected varies linearly as a function of position in the field region.

Adopting the Cartesian coordinate system of FIG. 1, this condition is met by a quadrupole electrostatic field wherein the distribution of electrostatic potential V(x,y) satisfies the condition $$V(x,y) = V_o(x^2 - y^2) \quad (1)$$

where $V_o$ is a constant and x,y are the X,Y position coordinates in the field region.

An electrostatic field of this form has four-fold symmetry about the Z-axis and could be generated using a quadrupole electrode structure (which provides field in all four quadrants) or monopole electrode structure (which provides field in only one of the quadrants).

Quadrupole and monopole electrode structures are of course known in mass analysis spectrometry; however, in contrast to this invention, such known electrode structures operate at radio frequencies.

Figure 2:
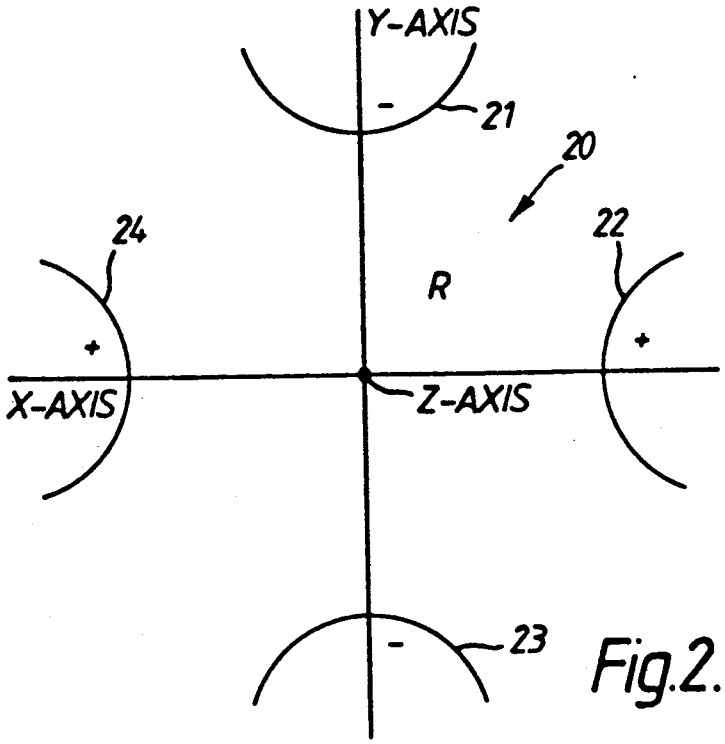
FIG. 2 shows a transverse, cross-sectional view through an ion mirror in the form of a quadrupole electrode structure.

The quadrupole electrode structure 20 shown in FIG. 2 comprises four elongate electrodes 21, 22, 23 and 24 disposed symmetrically around the longitudinal Z-axis such that one pair of electrodes 22, 24 is centred on the transverse X-axis and the other pair of electrodes 21, 23 is centred on the mutually orthogonal Y-axis. The electrodes have inwardly facing electrode surfaces defining a field region R, one pair of electrodes (on the X-axis, say) being maintained at a positive d.c. voltage and the other pair of electrodes (on the Y-axis) being maintained at a negative d.c. voltage. With this electrode arrangement, the electrostatic field created in region R is effective to reflect positively-charged ions introduced into region in the X-Z plane and to reflect negatively-charged ions introduced into the field region in the Y-Z plane.

Figure 3A:
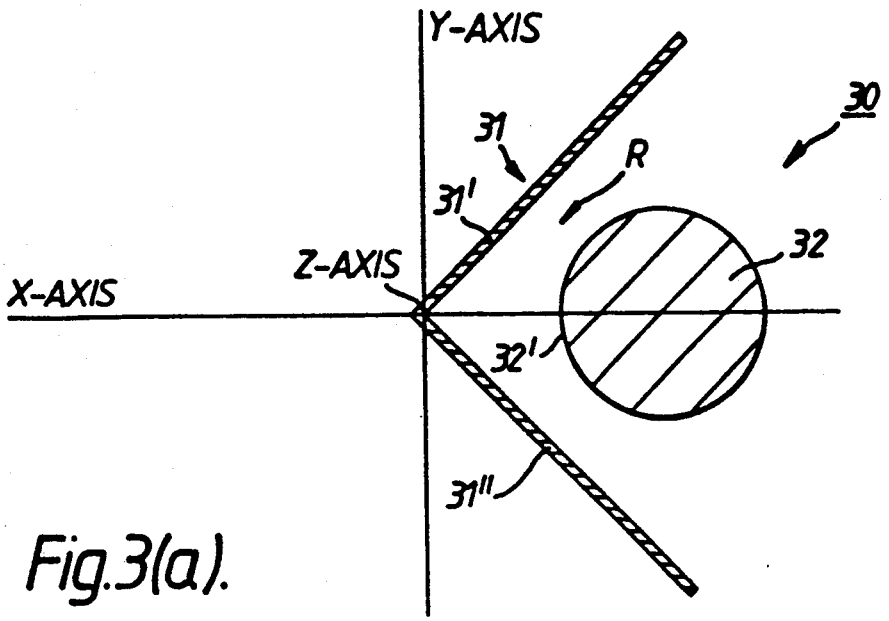
FIGS. 3*a* and 3*b* show a transverse cross-sectional view and a perspective view respectively of an ion mirror in the form of a monopole electrode structure.
Figure 3B:
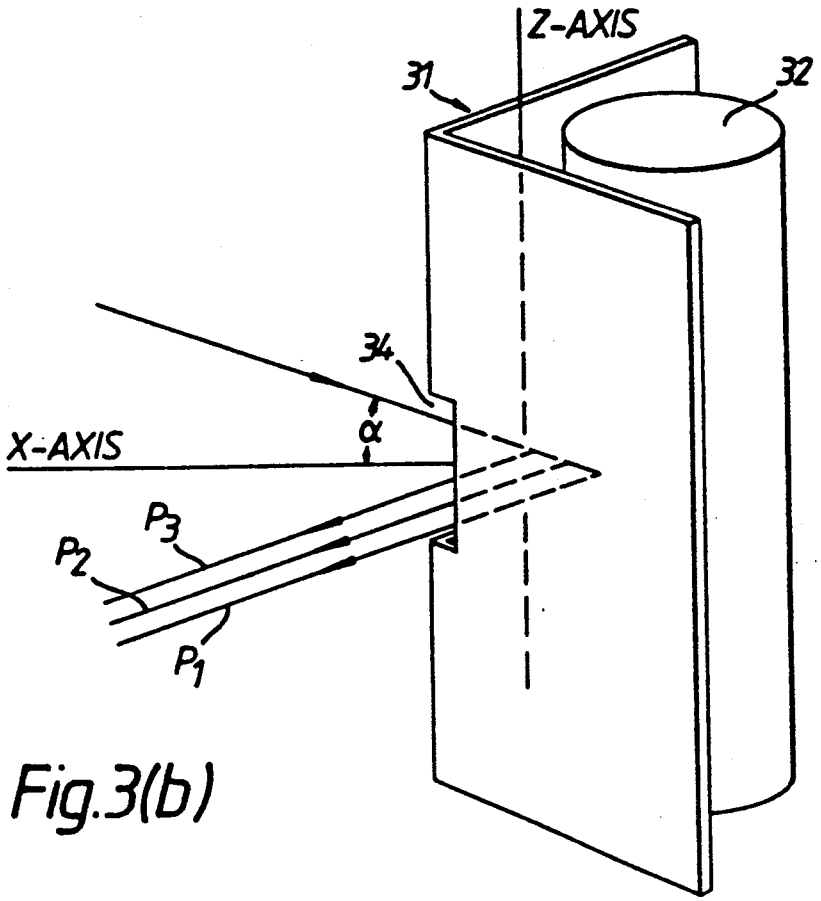

The monopole electrode structure 30, shown in FIGS. 3*a* and 3*b*, comprises two elongate electrodes 31, 32 which extend parallel to the longitudinal Z-axis of the electrode structure, and are spaced apart from each other on the transverse X-axis.

The two electrodes have inwardly facing electrode surfaces which are disposed symmetrically with respect to the X-Z plane and define an intermediate field region R.

Electrode 31 has a substantially V-shaped transverse cross-section and comprises a pair of flat, mutually inclined electrode plates 31', 31'' which meet at an apex 33. Electrode 32, on the other hand, is in the form of a rod and its electrode surface 32' may have a circular or hyperbolic transverse cross-section.

As shown in FIGS. 3*b*, electrode 31 has an elongate window 34 by which the ions may enter the field region for reflection in the X-Z plane. To that end, one of the electrodes is maintained at a fixed d.c. voltage with respect to the other electrode. If, for example, electrode 32 is maintained at a positive d.c. voltage with respect to electrode 31, the electrostatic field created in the field region R would be such as to reflect positively-charged ions. Conversely, if electrode 32 is maintained at a negative d.c. voltage with respect to electrode 31, the electrostatic field would be such as to reflect negatively-charged ions.

In the example of FIG. 3*b*, the ions enter the field region on a path which is inclined at an angle $\alpha$ to the transverse X-axis and, as described hereinbefore with reference to FIG. 1, ions which have different masses ($M_1$, $M_2$, . . . $M_n$) have different flight times.

At positions away from the X-Z plane, the monopole electrode structure shown in FIGS. 3*a* and 3*b* may give rise to undesirable field components acting in the Y-axis direction (normal to the X and Z-axis directions). The effect of these undesirable field components can be reduced by providing an electrode structure whose dimensions are large compared with the width of the ion beam and by the use of ion source optics arranged to produce a sharp, well-defined beam confined as closely as possible to the X-Z plane.

Similarly, by making the electrode structure relatively long in the Z-axis direction the effect of unwanted field components acting in the Z-axis direction is reduced also.

Also, the effect of fringing fields and/or unwanted field components can be reduced using appropriately shaped electrodes and/or other means of field correction known to those in the art.

Figure 4A:
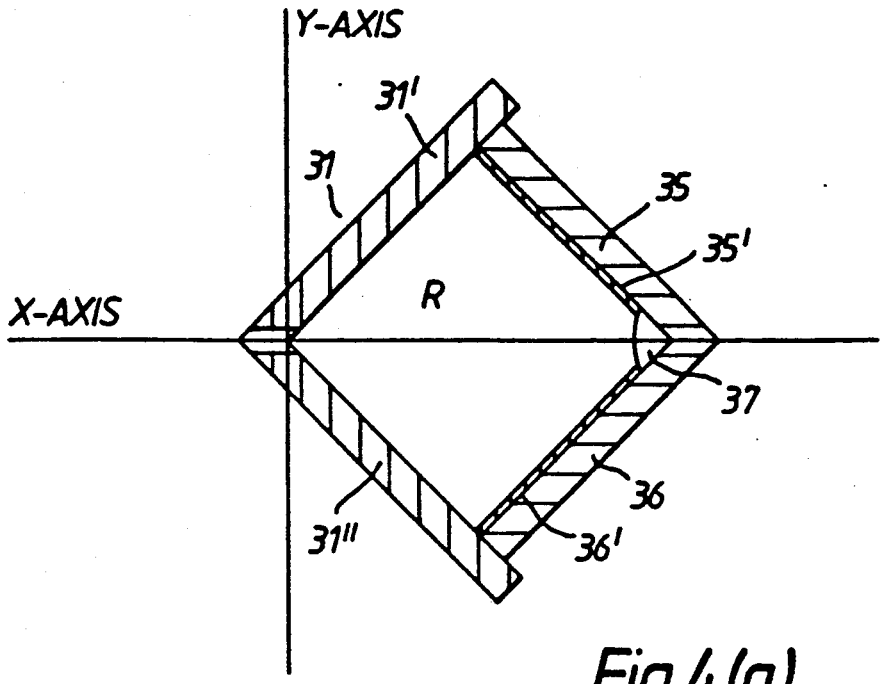
FIG. 4*a* shows a transverse cross-sectional view through another monopole electrode structure in accordance with the invention.

FIG. 4*a* shows a transverse cross-sectional view through an alternative monopole electrode structure. This electrode structure has a pair of orthogonally inclined side walls 35, 36 made from an electrically insulating material, such as glass. The side walls abut the electrode plates 31', 31'', as shown, to form a boundary structure enclosing a field region R of square cross-section. An electrode 37, positioned at the apex of the side walls, is maintained at an appropriate d.c. retarding voltage with respect to the electrode plates 31, 31', and the side walls bear respective coatings 35', 36' of an electrically resistive material interconnecting the electrode 37 and the electrode plates 31', 31''. The structure may also have coated end walls (not shown) which serve to terminate electrostatic field lines extending in the Z-axis direction and so, in effect, simulate a structure having infinite length in that direction.

Figure 4B:
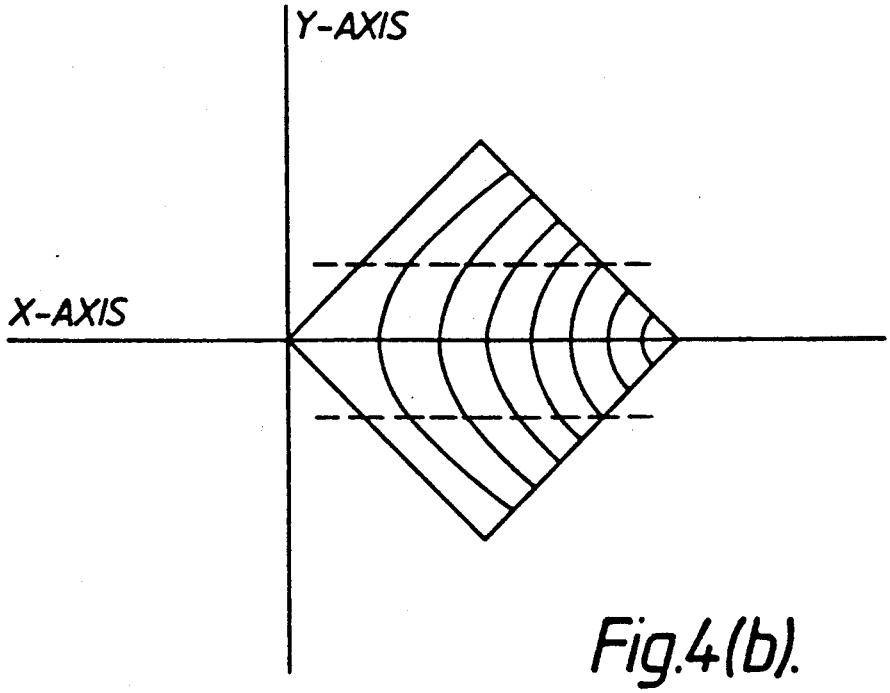
FIG. 4*b* illustrates equipotential lines produced by the monopole electrode structure of FIG. 4*a*.

The quadrupole electrostatic field created by this electrode structure has hyperbolic equipotential lines in the transverse (X-Y) plane, as defined by equation 1 above. These equipotential lines are illustrated in FIG. 4*b*. The voltage varies linearly along the side walls, in the transverse direction, from the voltage value at electrode 37 to the voltage value at electrode plates 31', 31''. The coatings 35', 36' should, therefore, ideally be of uniform thickness. However, such coatings may be difficult to deposit in practice.

Figure 4C:
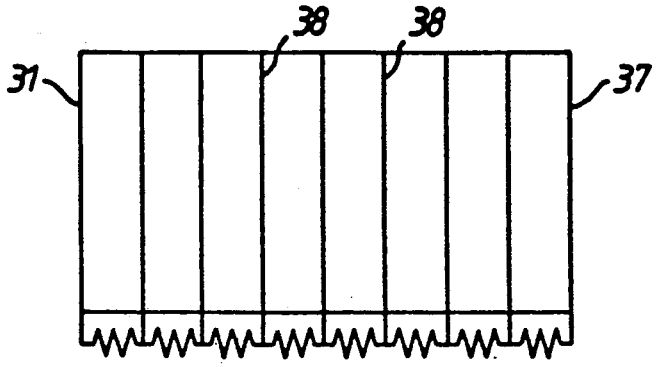
FIG. 4*c* shows a side elevation view of a side wall of the monopole electrode structure of FIG. 4*a*.

In an alternative embodiment, the coatings are replaced by discrete electrodes 38 provided on the side and/or end walls along the lines of intersection with selected equipotentials. Each such electrode 38 is maintained at a respective voltage intermediate that at electrode 37 and that at electrode plate 31', 31''. Since the voltage must vary linearly along each side wall, the electrodes provided thereon may lie on parallel, equally-spaced lines, as shown in FIG. 4*c*, and the required voltages may then be generated by connecting the electrodes together in series between plates 31, 31' and electrode 37 by means of resistors having equal resistance values.

The corresponding electrodes on the end walls would lie on hyperbolic lines, as illustrated in FIG. 4*b*.

Figure 5A:
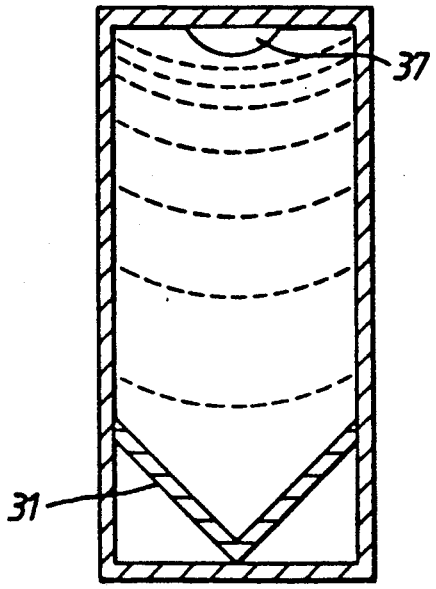
FIG. 5*a* shows a transverse cross-sectional view through a yet further monopole electrode structure in accordance with the invention.

FIG. 5*a* shows a transverse cross-sectional view through another monopole electrode structure in accordance with the invention. In this embodiment, the structure has a pair of parallel, electrically-insulating side walls 39, 39' giving a more compact structure in the transverse (Y-axis) direction.

Figure 5B:
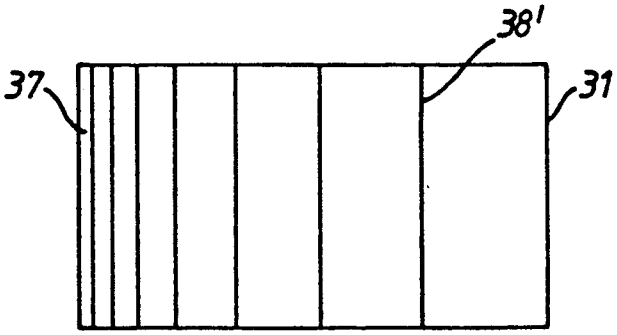
FIG. 5*b* shows a side elevation view of a side wall of the monopole electrode structure of FIG. 5*a*.

The side walls are shown in outline in FIG. 4*b*. It will be clear from that Figure that the voltage varies in a non-linear fashion along each side wall and, as shown in FIG. 5*b*, the electrodes 38 applied to the side walls are spaced progressively closer together in the direction approaching electrode 37.

In a yet further embodiment, the quadrupole field may have rotational symmetry about an axis, the X axis say. Such a field could be generated by an electrode structure comprising one electrode having a conical electrode surface and a second electrode having a spherical electrode surface facing the conical electrode surface. The second electrode would be maintained at a retarding voltage with respect to the first electrode.

Figure 6:
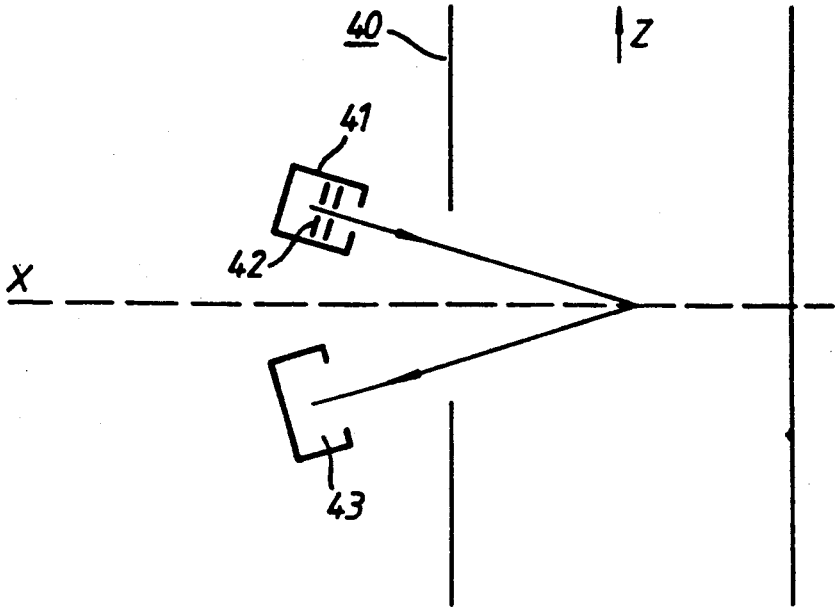
FIG. 6 illustrates a time-of-flight mass spectrometer incorporating the ion mirror of any one of FIGS. 3 to 5.

FIG. 6 shows a time-of-flight mass spectrometer incorporating an ion mirror in accordance with the invention. In addition to the ion mirror, referenced at 40, the spectrometer includes, inter alia, an ion source 41, having suitable collimating optics 42, and a detector 43 having a sufficiently large aperture and/or suitable focussing optics to capture, and enable detection of, all the ions exiting the ion mirror. The ion source and the detector are disposed to either side of the X-axis in the Z-X plane.

Resolving power may be enhanced by so increasing the dimensions of the spectrometer as to increase the flight times of ions within the field region.

Figure 7:
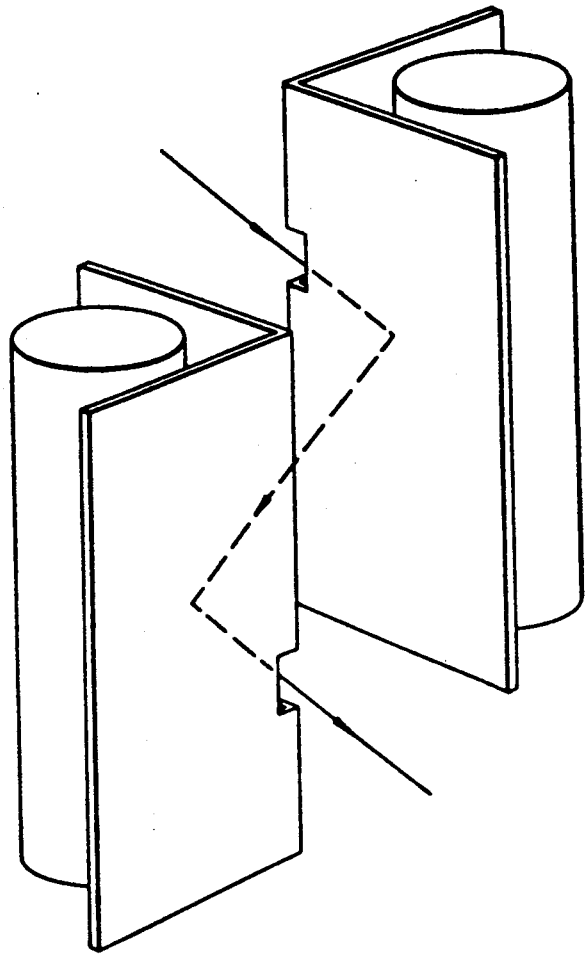
FIG. 7 shows a perspective view of an ion mirror having two, opposed monopole electrode structures.

Alternatively, resolving power could be increased by causing ions to undergo multiple reflections using, for example, two opposed monopole electrode structures, as shown in FIG. 7, or a quadrupole electrode structure injecting ions along the Z-axis.

Resolution could be further enhanced using more elaborate ion source optics and/or a reflectron or alternative time focussing arrangement, outside the ion mirror 40, as described hereinbefore, in order to compensate for a spread of flight times which would occur in the case of ions having different energies An ion mirror in accordance with the invention has particular applicability in a time-of-flight mass analyser used in the second stage of a mass spectrometry/ mass spectrometry experiment in which a parent ion, of mass $M_p$ say, undergoes fragmentation to yield daughter ions of smaller masses (e.g. $M_d$).

Following fragmentation, each daughter ion continues to move with substantially the same velocity as the parent ion, but with a fraction e.g.($M_d$ of the original $M_p$) energy of the parent ion. Since, the ion mirror distinguishes ions on the basis of mass only, even though the ions have different energies, it is clearly ideal for obtaining a daughter ion spectrum, which provides useful structural information about the parent ion.

Figure 8:
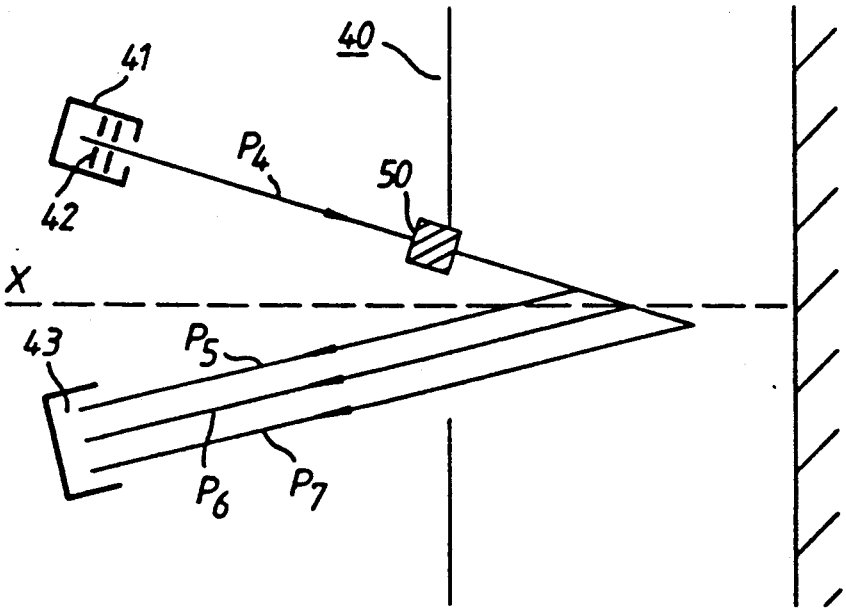
FIG. 8 shows the time-of-flight mass spectrometer of FIG. 6 used to obtain a daughter ion mass spectrum.

In a preferred arrangement, shown in FIG. 8, the parent ion is caused to dissociate at the entrance to the ion mirror, and such dissociation may be effected using suitable means 50, such as a collision cell, a laser beam or an electron beam. By causing the parent ion to dissociate close to the entrance of the ion mirror, a spread of flight times, which would tend to arise outside the ion mirror due to the different energies of the daughter ions and due also to the energy released by the parent ion when dissociation takes place, is reduced.

Following dissociation of the parent ion, the various daughter ions, having masses $M_D(1)$, $M_D(2)$ say, move with the same velocity along an inclined path $P_4$. As before, each ion occupies the field region of the ion mirror for a total time interval related only to its mass, and so ions having different masses exit the field region at different times, on different paths e g. $P_5$, $P_6$ and $P_7$, of which the outermost path $P_7$ corresponds to the heaviest ion (i.e. undissociated parent ions) and paths $P_5$ and $P_6$ correspond to daughter ions having masses $M_D(1)$ and $M_D(2)$ respectively, where $M_D(2) > M_D(1)$.

Since the detector must be capable of detecting both the lightest daughter ion and the parent ion it may be necessary to adjust the inclination of path $P_4$ to suit the particular operational conditions.

I claim:

1. An ion mirror for use in a time-of-flight mass spectrometer, for reflecting ions travelling along a path, comprising means defining a field region for subjecting each ion in the field region to only a static electric reflecting field causing the ion to be reflected in, or about, a plane characterised in that the static electric reflecting field is a static electric quadrupole field whereby the ion occupies the field region for a time interval related to the mass, but not the energy, of the ion.

2. An ion mirror as claimed in claim 1, wherein each ion enters and exits the field region at different positions on an axis normal to said plane.

3. An ion mirror as claimed in claim 1 or claim 2, wherein the means defining the field region is a quadrupole electrode structure operating at a d.c. voltage.

4. An ion mirror as claimed in claim 1 or claim 2, wherein the means defining the field region is a monopole electrode structure operating at a d.c. voltage.

5. An ion mirror as claimed in claim 4, wherein the monopole electrode structure comprises a first electrode having an electrode surface of substantially V-shaped transverse cross-section and a second electrode having an electrode surface of curvilinear transverse cross-section facing the electrode surface of the first electrode wherein the second electrode is maintained, in operation, at a d.c. retarding voltage with respect tot he first electrode and the first electrode has an aperture by which ions can enter and exit the field regions between the facing electrode surfaces.

6. A time-of-flight mass spectrometer comprising an ion source, an ion mirror as claimed in claim 1 and detection means for detecting ions reflected by the ion mirror.

7. A time-of-flight mass spectrometer as claimed in claim 6, and including means for subjecting the ions to a static electric field outside the field region.

8. A time-of-flight mass spectrometer as claimed in claim 6, including means to dissociate a parent ion prior to entry thereof into the field region.

9. A time-of-flight mass spectrometer as claimed in claim 7 including means to dissociate a parent ion prior to entry thereof into the field region.

10. A method of reflecting incident ions including generating only a static electric quadrupole field and introducing ions into the field, whereby each ion occupies the field region for a time interval related to the mass, but not the energy of the ion.

11. A method as claimed in claim 10, for distinguishing a parent ion form a daughter ion including the additional step of dissociating parent ions prior to entry of the ions into the static electric quadrupole field, and detecting undissociated parent ions and resulting daughter ions.

12. An ion mirror for use in a time-of-flight mass spectrometer for reflecting ions travelling along a path comprising means defining a field region for subjecting each ion in the field region to only a static electric reflecting field causing the ion to be reflected in, or about, a plane, wherein the means defining the field region is a monopole electrode structure operating at a d.c. voltage for subjecting each ion to a static electric quadrupole field whereby the ion occupies the field region for a time interval related to the mass, but not the energy of the ion, and the monopole electrode structure comprises an electrically conductive member having a substantially V-shaped transverse cross-section and an electrically resistive member having a substantially V-shaped transverse cross-section wherein the electrically conductive and the electrically resistive members define a closed structure bounding the field region, the apex of the electrically resistive member is maintained in operation at a d.c. retarding voltage with respect to the electrically conductive member and the electrically conductive member has an aperture by which ions can enter and exit the field region.

13. An ion mirror as claimed in claim 12 wherein the ions enter and exit the field region at different positions.

14. An ion mirror as claimed in claim 12, wherein the monopole electrode structure also has electrically resistive end walls.

15. An ion mirror for use in a time-of-flight mass spectrometer for reflecting ions travelling along a path, comprising means defining a field region for subjecting each ion in the field region to only a static electric reflecting field causing the ion to be reflected in, or about, a plane, wherein the means defining the field region is a monopole electrode structure operating at a d.c. voltage for subjecting each ion to a static electric quadrupole field whereby the ion occupies the field region for a time interval related to the mass, but not the energy of the ion, and the monopole electrode structure comprises an electrically conductive member having a substantially V-shaped transverse cross-section, electrode means facing the electrically conductive member which is maintained in operation at a d.c. retarding voltage with respect to the electrically conductive member and electrically insulating side walls, wherein the electrically insulating side walls bear a plurality of electrodes along respective lines of intersection with selected equipotentials in the static electric quadrupole field and each electrode is maintained at a respective voltage.

16. An ion mirror as claimed in claim 15 wherein the ions enter and exit the field region at different positions.

17. An ion mirror as claimed in claim 15, wherein the electrically insulating side walls are formed by an electrically insulating member having a substantially V-shaped transverse cross-section wherein the electrically conductive member and the electrically insulating member define a closed structure bounding the field region, and said electrode means is located at the apex of the electrically insulating member.

18. An ion mirror as claimed in claim 15, wherein said side walls are parallel.

19. An ion mirror as claimed in claim 15, wherein the monopole electrode structure has electrically insulating end walls also bearing a plurality of electrodes along respective lines of intersection with selected equipotentials in the static electric quadrupole field, each electrode on the end walls being maintained at a respective voltage.

20. A mass spectrometry system comprising a first mass spectrometry means for providing parent ions, means for causing fragmentation of the parent ions to yield daughter ions and a second mass spectrometry means for analyzing the masses of the daughter ions, wherein the second mass spectrometry means comprises an ion mirror having means defining a field region for subjecting ions to only a static electric quadrupole field and having the property that each ion occupies the field region for a time interval related to the mass, but not the energy of the ion.

* * * * *